United States Patent [19]

Beaver et al.

[11] Patent Number: 4,666,579

[45] Date of Patent: May 19, 1987

[54] STRUCTURAL FRAME FOR A SOLID POLYMER ELECTROLYTE ELECTROCHEMICAL CELL

[75] Inventors: Richard N. Beaver, Angleton; Gregory J. E. Morris; Hiep D. Dang, both of Lake Jackson; John R. Pimlott, Sweeny, all of Tex.

[73] Assignee: The Dow Chemical Company, Midland, Mich.

[21] Appl. No.: 809,364

[22] Filed: Dec. 16, 1985

[51] Int. Cl.[4] ..... C25B 9/04; C25B 13/02; C25B 9/00

[52] U.S. Cl. ..... 204/253; 204/258; 204/279; 204/283

[58] Field of Search ..... 204/252–258, 204/263–266, 279, 283

[56] References Cited

U.S. PATENT DOCUMENTS

| | | | |
|---|---|---|---|
| 3,849,279 | 11/1974 | Barkel | 204/254 |
| 3,873,437 | 3/1975 | Pulver | 204/254 |
| 3,909,378 | 9/1975 | Walmsley | 204/98 |
| 4,025,405 | 5/1977 | Dotson et al. | 204/98 |
| 4,065,366 | 12/1977 | Oda et al. | 204/98 |
| 4,085,027 | 4/1978 | Poush et al. | 204/254 X |
| 4,116,888 | 9/1978 | Ukihashi et al. | 521/31 |
| 4,123,336 | 10/1978 | Seko et al. | 204/98 |
| 4,126,588 | 11/1978 | Ukihashi et al. | 521/31 |
| 4,151,052 | 4/1979 | Goto et al. | 204/95 |
| 4,176,215 | 11/1979 | Molnar et al. | 521/27 |
| 4,178,218 | 12/1979 | Seko | 204/98 |
| 4,192,725 | 3/1980 | Dotson et al. | 204/98 |
| 4,209,635 | 6/1980 | Munekata et al. | 560/183 |
| 4,212,713 | 7/1980 | Suhara et al. | 204/98 |
| 4,251,333 | 2/1981 | Suhara et al. | 204/98 |
| 4,270,996 | 6/1981 | Suhara et al. | 204/98 |
| 4,329,435 | 5/1982 | Kimoto et al. | 521/38 |
| 4,330,654 | 5/1982 | Ezzell et al. | 526/243 |
| 4,337,137 | 6/1982 | Ezzell | 204/252 |
| 4,337,211 | 6/1982 | Ezzell et al. | 260/456 F |
| 4,340,452 | 7/1982 | deNora | 204/129 |
| 4,340,680 | 7/1982 | Asawa et al. | 521/27 |
| 4,357,218 | 11/1982 | Seko | 204/98 |
| 4,358,412 | 11/1982 | Ezzell et al. | 260/968 |
| 4,358,545 | 11/1982 | Ezzell et al. | 521/27 |
| 4,444,632 | 4/1984 | deNora | 204/98 |
| 4,444,641 | 4/1984 | Oda et al. | 204/286 |
| 4,457,815 | 7/1984 | Levin | 204/98 |
| 4,457,823 | 7/1984 | LaConti et al. | 204/282 |
| 4,488,946 | 12/1984 | Morris et al. | 204/98 |
| 4,560,452 | 12/1985 | Morris et al. | 204/254 X |
| 4,568,434 | 2/1986 | Morris et al. | 204/254 X |
| 4,581,114 | 4/1986 | Morris et al. | 204/254 X |
| 4,873,437 | 3/1975 | Pulver | 204/254 |

*Primary Examiner*—Donald R. Valentine
*Attorney, Agent, or Firm*—James H. Dickerson, Jr.

[57] ABSTRACT

A structural frame adapted for use in a solid polymer electrochemical cell, which comprises a generally planar organic plastic member having a plurality of horizontally and vertically spaced-apart shoulders protruding outwardly from opposing generally coplanar anolyte and catholyte surfaces of the plastic member. Electrically conductive, hydraulically impermeable, anolyte and catholyte corrosion resistant covers are matingly affixed to the respective surfaces of the plastic member. A hydraulically permeable, electrically conductive, current collector is contacting and positioned adjacent the catholyte cover. An ion exchange membrane, having an electrically conductive, electrocatalytic material bonded to or embedded in the surface of the membrane is positioned adjacent and in contact with the current collector. The frames are removably and sealably positioned in coplanar relationship, each plastic member being spaced apart by an anode on one side and a cathode on the other.

27 Claims, 1 Drawing Figure

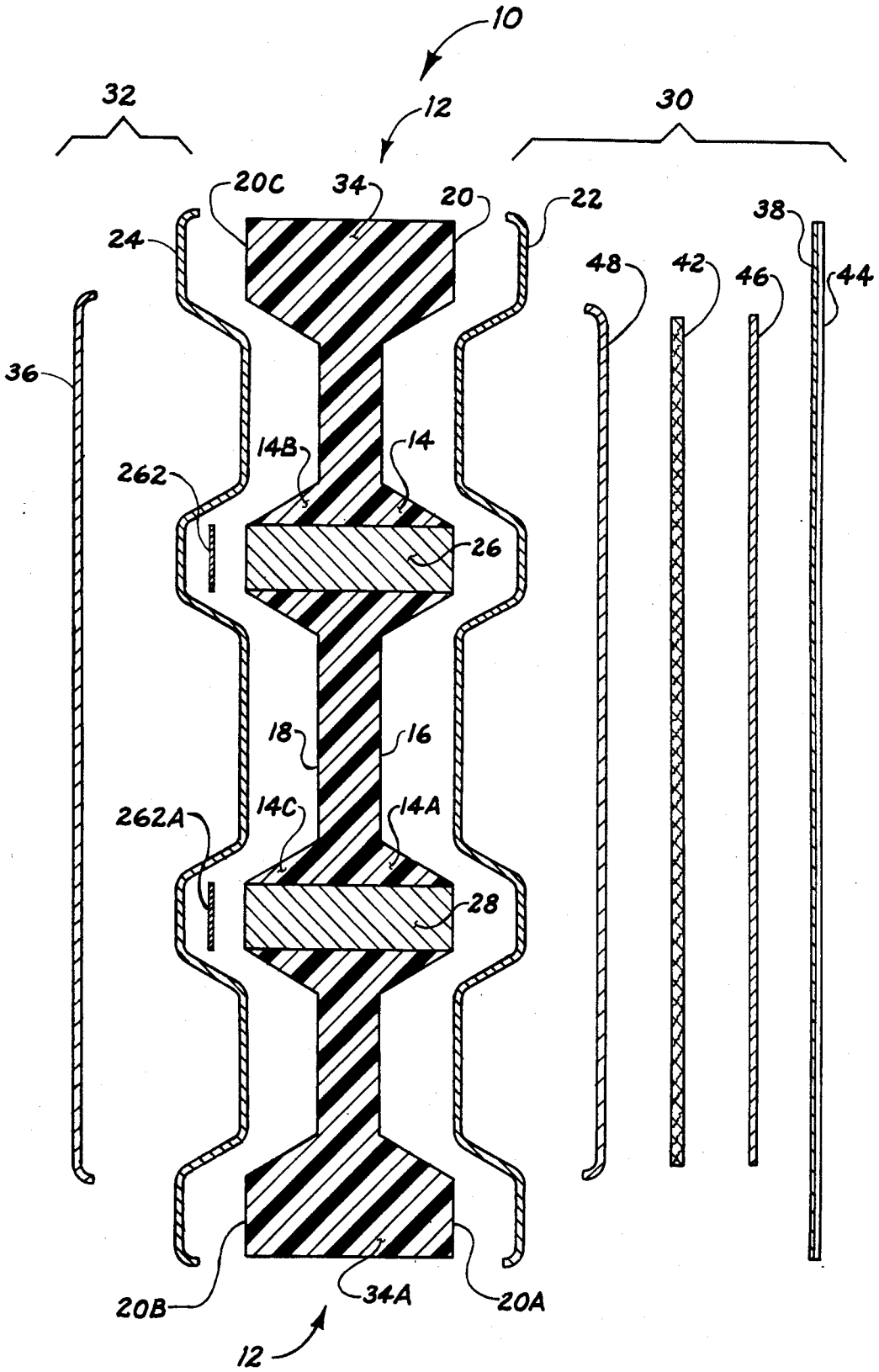
10
12
32
30
20C
34
20
22
24
38
48
42
46
44
36
14B
14
262
26
18
16
262A
14C
14A
28
20B
34A
20A
12

STRUCTURAL FRAME FOR A SOLID POLYMER ELECTROLYTE ELECTROCHEMICAL CELL

BACKGROUND OF THE INVENTION

This invention relates to an improvement in the structure of filter press solid polymer electrolyte electrolysis cells. More particularly it relates to those of such cells which employ permselective ion exchange membranes having an electrocatalytic material bonded to or embedded in the membrane and acting as anodes or cathodes. Such cells are particularly useful in the electrolysis of aqueous solutions of alkali metal chlorides; especially in the electrolysis of aqueous solutions of sodium chloride (sodium chloride brine). The cell structure may also be used in electrolyzing other solutions to make products such as potassium hydroxide, iodine, bromine, bromic acid, persulfuric acid, chloric acid, adiponitrile and other organic compounds made by electrolysis.

It is well established that various chemicals can be produced in an electrolytic cell containing an anode and a cathode. For example, alkali metal chlorates, such as sodium chlorate, have been formed electrolytically from a sodium chloride brine in cells without a separator positioned between the anode and the cathode.

When a separator, such as a liquid permeable asbestos or polytetrafluoroethylene diaphragm or a substantially completely liquid impervious ion exchange membrane, is used in a cell to electrolyze a sodium chloride brine, the electrolytic products will normally be gaseous chlorine, hydrogen gas, and an aqueous solution containing sodium hydroxide.

For a number of years gaseous chlorine was produced in electrolytic cells wherein an asbestos diaphragm was interposed between finger-like, anodes and cathodes which were interleaved together. During the past several years it has become apparent that the use of a substantially liquid impermeable cation exchange membrane may be preferable to the more well established diaphragm in instances where a higher purity, for example a lower sodium chloride content, higher sodium hydroxide product is desired. It was found to be more convenient to fabricate ion exchange type electrolytic cells from relatively flat or planar sheets of ion exchange membrane rather than to interleave the membrane between the anode and cathode within the older finger-like cells used with asbestos diaphragms.

The newer, so-called flat plate electrolytic cells using a planar piece of ion exchange membrane to separate the anolyte from catholyte compartments also have a plurality of solid, liquid impervious frames adapted to support the anode on one side and the cathode on the opposite side. These frames have previously been constructed of materials such as metal and plastic, but neither of these materials has been found to be entirely satisfactory. In any electrolytic cell, including both monopolar and bipolar cells, there is a possibility that electrolyte may leak from within the cell to the exterior. In instances where such leakage has occurred in cells with iron or other ferrous type frames, it was found that the iron frame corroded or was itself electrolytically attacked. Plastic frames are not generally subject to the electrolytic attack, but are normally not resistant to the anolyte and/or catholyte within the cell under operating conditions for extended periods of time, for example, several years.

Solid polymer electrolyte membranes consist of an ion exchange membrane having an electrically conductive, electrocatalytic material embedded in or bonded to at least one side of the ion exchange membrane. Such electrodes are well known in the art and are illustrated in, for example, U.S. Pat. Nos. 4,457,815 and 4,457,823. Solid polymer electrolyte membranes have been used as electrodes in processes and devices for the generation of chlorine and hydrogen by electrolysis of an aqueous alkali metal halide and for the electrolysis of water. The catalytic electrodes at which the chlorine and hydrogen are produced are thin, porous, gas permeable catalytic electrodes which are bonded to or embedded in opposite surfaces of the membrane so that the chlorine and hydrogen are generated (substantially) at the electrode membrane interfaces. This results in electrodes which have very low overvoltages for chlorine and hydrogen discharge.

It is desired to provide a solid polymer electrolyte electrolytic cell having a structural frame which would minimize the corrosion problems and would increase the relatively short useful life attendant with those frames used by the prior art.

SUMMARY OF THE INVENTION

The present invention is a structural frame adapted for use in a solid polymer electrolytic cell which comprises a generally planar organic plastic member having a plurality of horizontally and vertically spaced-apart shoulders protruding outwardly from opposing generally coplanar anolyte and catholyte surfaces of the plastic member. Each of the shoulders annularly encircles and supports an electrically conductive insert extending from an exterior face of a shoulder on the catholyte surface of the plastic member, through the plastic member, to an exterior face of a shoulder on the anolyte surface of the plastic member.

An electrically conductive, substantially completely hydraulically impermeable anolyte cover is matingly affixed to the anolyte surface of the plastic member and adapted to minimize contact between the anolyte and the plastic member. The anolyte cover is resistant to the corrosive effects of the anolyte. An electrically conductive, substantially completely hydraulically impermeable catholyte cover is matingly affixed to the catholyte surface of the plastic member and adapted to minimize contact between the catholyte and the plastic member. The catholyte cover is a metal resistant to the corrosive effects of the catholyte. Both the anolyte cover and the catholyte cover may be made from a metal, or, optionally made from another material and have metallic inserts molded in at the points where they contact the metallic inserts which pass through the plastic member.

A hydraulically permeable, electrically conductive, current collector is contacting and positioned adjacent to the catholyte cover. A ion exchange membrane, having an electrically conductive, electrocatalytic material bonded to or embedded in the surface of the membrane, contacts and is positioned adjacent to the current collector.

The invention further includes an electrolytic cell utilizing a plurality of the above described structural frames removably and sealably positioned in a generally coplanar relationship with each other and with each of the plastic members being spaced apart at least by an anode on one side of the plastic member and a cathode on an opposing side of the plastic member.

DESCRIPTION OF THE DRAWINGS

The FIGURE is an exploded sectional side view of the cell structure of a solid polymer electrolyte filter press-type cell unit 10 which employs the unitary central cell element 12.

DESCRIPTION OF THE PREFERRED EMBODIMENTS

The FIGURE shows structural frame 10 which achieves the above objects. It is illustrated for use in an electrolytic cell for producing gaseous chlorine from an aqueous alkali metal hydroxide solution. Although the present invention can be beneficially employed to produce chlorine and various alkali metal hydroxide solutions, it is preferred to use sodium chloride as the primary salt in the starting brine since this particular salt is readily available commercially and there are many well established uses for sodium hydroxide produced electrolytically.

The cell structure 10 includes a generally planar organic plastic member 12 which can be produced by commercial and known procedures into a shape with a plurality of horizontally and vertically spaced apart shoulders 14, 14*a*, 14*b*, and 14*c*. The shoulders 14, 14*a*, 14*b*, and 14*c* protrude outwardly from catholyte and anolyte surfaces 18 and 16, respectively. The peripheral surfaces 20, 20*a*, 20*b*, and 20*c* of the plastic member 12 define the outer surface of the electrolytic cell 10 when a plurality of the plastic members are positioned together. The peripheral configuration of the plastic members 12 is optional and can be varied to suit the particular configuration of the electrolytic cell shape desired.

The number, size and shape of these shoulders may be an important consideration in both the design and operation of the present invention. They may be square, rectangular, conical, cylindrical, or any other convenient shape when viewed in sections taken either parallel or perpendicular to the central portion. The shoulders may have an elongated shape to form a series of spaced ribs distributed over the surface of the plastic member.

A number of plastic materials are suitable for use in the present invention for the construction of plastic member 12. Without intending to be limited by the specific organic materials hereinafter delineated, examples of such suitable materials include polyethylene; polypropylene; polyvinylchloride; chlorinated polyvinyl chloride; acrylonitrile, polystyrene, polysulfone, styrene acrylonitrile, butadiene and styrene copolymers; epoxy; vinyl esters; polyesters; and fluoroplastics and copolymers thereof. It is preferred that a material such as polypropylene be used for the structural member 12 since it produces a shape with adequate structural integrity at elevated temperatures, is readily available, and is relatively inexpensive with respect to other suitable materials.

It is surprising that the plastic member 12 can be produced by any of a number of processes known well to those skilled in the art of plastic molding. Such molding processes include, for example, injection molding, compression molding, transfer molding, and casting. Of these processes, injection molding has been found to satisfactorily produce a structure with adequate strength for use in an electrolytic cell. Preferably, the plastic is injected into a mold containing the desired number of inserts (discussed later). In this manner, the plastic member is a one-piece member which fits tightly around the inserts, holds them in place, and provides a high degree of support to them. Such a configuration minimizes the likelihood that the inserts will separate from the plastic member and become loose. The ease of molding relatively complex shapes and the strength of the finished injection molded article contribute to making this process preferred for making the herein described structural member. This is a considerable advantage over the prior art where the plastic frame was molded first and then the electrical conductors were subsequently installed.

When the plastic member 12 is employed in an electrolytic cell for producing chlorine, the temperature of the cell and the plastic member will frequently reach, or be maintained at, temperatures of from about 60° to about 90° Celsius. At these temperatures plastics, as do most materials, expand a measurable amount. Any expansion and later contraction on cooling of the plastic frame could result in electrolyte seeping from within the plurality of cells when joined together or, more importantly, could result in distortion of the anode and cathode which are made of metallic expanded mesh or perforated sheets. Furthermore, the differential expansion between the plastic frame 22 and the catholyte cover 22 and anolyte cover 24 would create stress on the welds which affix these covers to the inserts which are themselves molded in the plastic frame.

To reduce, and preferably minimize, the difference in expansion between the covers 22 and 24 and the plastic member 12, it is preferred to incorporate an additive to reduce thermally induced expansion of the plastic member. More preferably, the additive will also increase the structural strength of the finished plastic article. Such additive can be, for example, fiberglass, graphite fibers, carbon fibers, talc, glass beads, pulverized mica, asbestos, and the like, and combinations thereof. It is preferred that the plastic contain from about 5 to about 75 weight percent additive, and more preferably from about 10 to about 40 weight percent of the additive. Glass fibers can be readily mixed with polypropylene to produce an injectable material suitable for use in the present invention which results in a solid, physically strong body with a coefficient of expansion less than polypropylene not containing glass fibers.

It has been determined that the use of commercially available polypropylene which has been specially formulated to afford bonding with the glass works particularly well. This results in a composite having a lower coefficient expansion than a mixture of polypropylene and glass fibers. Such chemically-combined glass fiber reinforced polypropylene is available from, for example, Hercules, Inc., Wilmington, Del., as Pro-fax PC072 polypropylene.

At least one electric conducting element, such as insert 26 or 28, is positioned and preferably molded into the plastic member 12. The insert 26 or 28 extends through the plastic member from the catholyte surface 16 to the anolyte surface 18. The inserts 26 and are preferably retained within the plastic member 12 by means of friction between the plastic and the insert. It is more preferable to increase the friction between these two bodies by having an additional means to restrain the insert within the plastic. Such additional means include, for example grooves (one or more) around the circumference of the insert(s), keys welded to the insert, hole(s) extending into and/or through the insert, slots, rings, collars, studs, or bosses.

The inserts 26 or 28 can be any material which will permit the flow of an electric current between the catholyte cover 22 and the anolyte cover 24. Since the covers 22 and 24 are preferably metallic, it is convenient to fabricate the insert from a metal, such as aluminum, copper, iron, steel, nickel, titanium, and the like, or alloys or physical combinations including such metals.

The shoulders and inserts should be spaced so they provide a somewhat uniform and low electrical potential gradient across the face of the electrode to which they are attached. They should be spaced so that they allow free fluid circulation from any unoccupied point within their respective electrolyte compartment to any other unoccupied point within that compartment. Thus the shoulders will be somewhat uniformly spaced apart from one another in their respective compartments.

To improve the flow of DC electric current between the covers 22 and 24, the inserts 26 or 28 is preferably made of a material weldably compatible with the particular cover it contacts. For example, the inserts 26 or 28 may be a welded assembly of a steel insert with a vanadium disk 262 or 262*a* interposed between, and welded to, both the insert and the cover 24.

To prevent catholyte from contacting the plastic member 12 within the electrolytic cell and causing deterioration of the plastic and/or leakage of electrolyte between the plastic and the inserts 26 or 28 from cathode compartment 30 to anode compartment 32 the cover 22 is matingly contacted with the catholyte surface 16 and the anolyte cover 24 is matingly contacted with the anolyte surface 18. As is shown in the FIGURE, both the anolyte and the catholyte covers are so shaped to correspond and abut closely to the exterior surface of the plastic member 12. It is important that the portions of both of the covers 22 and 24 which are exposed to the anolyte or catholyte and span the plastic member contain no openings through which electrolyte or electrolytic products can pass during operation of the electrolytic cell. The freedom from openings through the covers minimizes the likelihood that electrolyte will leak or seep through holes or spaces around gaskets of other seals and come into contact with the plastic member. The degree of correspondence may be more or less than illustrated in the FIGURE. In some instances, the electrode compartment covers 22 or 24 may about the frame 10 in one or more locations.

The anolyte cover 24 is made of a material which is resistant to the anolyte during operation of the cell. Normally, this material is not electrolytically active, but the invention is still operable if the material does become or is active electrolytically. Suitable materials for the anolyte cover 24 are, for example, titanium, tantalum, zirconium, tungsten, and other valve metals not materially affected by the anolyte. Titanium is preferred as the anolyte cover material.

The catholyte cover 22 is resistant to attack by the catholyte under the conditions present in the electrolytic cell. Suitable materials for the catholyte cover include, for example, iron, steel, stainless steel, nickel, lead, molybdenum, and cobalt and alloys, including major portions of these metals. Nickel, including nickel base alloys, is preferably used for the catholyte cover material, since nickel and nickel alloys are generally resistant to the corrosive effects of the catholyte, especially an aqueous catholyte solution containing up to at least about 35 weight percent sodium hydroxide. Steel has also been found to be suitable, and relatively inexpensive, for use in a cell as a catholyte cover in the presence of a dilute (i.e., up to about 22 weight percent) aqueous solution of sodium hydroxide.

To assist in assembling a plurality of the structural frames 10 into an electrolytic cell it is desirable, although not essential, to have flanges 34 and 34*a* extending outwardly from the main structural portion of the plastic member 12 along the periphery of such member. In a preferred embodiment the flanges extend outwardly from the plastic member about the same distance as the inserts 26 or 28. Alternatively, but not preferred, separate spacer elements (not shown) could be utilized to build up the plastic member 12 sufficiently to permit a number of the plastic members to be combined into a cell series without having electrolyte, either anolyte or catholyte, leak from within the catholyte and anolyte compartments 30 and 32, respectively, to an exterior portion of the cell.

The FIGURE shows the anode as being a hydraulically permeable metallic sheet, while the cathode 38 is illustrated as a solid polymer electrolyte electrode. However, both electrodes could be a solid polymer electrolyte electrode, or the anode could be a solid polymer electrolyte anode while the cathode is a hydraulically permeable metallic sheet.

The FIGURE further shows an anode 36, which is positively charged during operation of the cell from an external power source (not shown), electrically connected to the anolyte cover 24. Such electrical connection is readily achieved by welding the anode 36 to the anode cover 24 where the anode cover comes into physical contact with the inserts 26 or 28. For improved electrical contact, the anolyte cover 24 is welded to the inserts 26 or 28 and the anode 36 is welded to the anolyte cover 24 adjacent to the inserts 26 or 28.

Various means of welding can be utilized in the present invention, but it has been found highly satisfactory to use resistance or capacitance discharge welding techniques. Other suitable welding techniques include tungsten inert gas welding (TIG) and metal inert gas (MIG) welding. This welding serves a primary purpose of retaining the anode 36 in position and not for electrical flow, although electric current will naturally pass through the welded areas.

At least one of the electrodes used in the cell of the present invention consists of a plurality of particles embedded in or bonded to an ion exchange membrane. Such electrodes are commonly referred to as solid polymer electrodes and are well known in the art.

Cation exchange membranes are well known to contain fixed anionic groups that permit intrusion and exchange of cations, while almost totally excluding anions from passage therethrough. Generally the membrane has a matrix of a cross-linked polymer, to which are attached charged radicals such as $—SO_3(-1)$, $—COO(-1)$, $—PO_3(-2)$, $HPO_2(-1)$, $—AsO_3(-2)$, and $SeO_3(-1)$. Vinyl addition polymers and condensation polymers may be employed. The polymer can be, for example, styrene, divinyl benzene, polyethylene and fluorocarbons. Condensation polymers are, for example, phenol sulfuric acid, and formaldehyde resins. Representative of the types of permselective membranes envisioned for use with this invention are those disclosed in the following U.S. Pat. Nos. 3,909,378; 4,025,405; 4,065,366; 4,116,888; 4,123,336; 4,126,588; 4,151,052; 4,176,215; 4,178,218; 4,192,725; 4,209,635; 4,212,713; 4,251,333; 4,270,996; 4,329,435; 4,330,654; 4,337,137; 4,337,211; 4,340,680; 4,357,218; 4,358,412; and 4,358,545. These patents are hereby incorporated by reference for the purpose of the membranes they disclose.

In forming the solid polymer electrodes of the present invention, the electrocatalytic materials may be bonded to and embedded in the ion exchange membrane, for example, in a thermoplastic fluorocarbon, or hot pressed to a thermoplastic fluorocarbon, or sintered, for example with polytetrafluoroethylene. The electrocatalyst may be blended with other materials, such as graphite or silver for enhanced electrical conductivity. The membrane may itself have a roughened surface, as provided by abrasion, a leachable pore forming material, or a volatile pore forming material. See for example U.S. Pat. No. 4,457,815.

Preferably, the electrocatalytic particles comprising the electrode (cathode or anode) are as fine a powder as is practical for use. Most preferably, the size of the particles are such that they pass through a 400 mesh U.S.S. Standard nylon screen.

Preferably, the surface area of the particles, as observed by the BET nitrogen absorption method, have a surface area of at least about 25 square meters per gram of electrocatalytic particles. More preferably, they have a surface area of from about 50 to about 150 square meters per gram of electrocatalytic particles. See for example U.S. Pat. No. 4,457,823.

Exemplary electrocatalyst materials for use in forming the anodes of solid polymer electrodes for use in the cell of the present invention include the platinum group metals as well as oxides and oxycompounds thereof, for example, platinum black, and isostructural oxycompounds such as platinum group metal perovskites, platinum group metal spinels and platinum group metal crystal defect semiconductors. An exemplary crystal defect semiconductor is the isostructural ruthenium dioxide-titanium dioxide. By oxycompounds of the platinum group metals are meant compositions of the platinum group with oxygen and another metal, as in spinels, perovskites, delafosites, and semiconductive oxides.

Exemplary electrocatalyst materials for use in forming the cathodes of solid polymer electrodes of the present invention include the transition metals of group 8 of the Periodic Table, as exemplified by iron, cobalt and nickel, especially when present in forms having enhanced surface area, i.e., enhanced surface activity. The high surface area forms include leached codeposits of the transition metal with zinc, leached deposited Raney alloys, and blacks, for example, platinum black, palladium black and the like.

When the cathode is a solid polymer electrolyte cathode, optionally, the anode 36 may be a hydraulically permeable metal sheet formed from materials such as one of the common film-forming metals, which is resistant to the corrosive effects of the anolyte during the operation of the cell. The anode can be made permeable by several means including, for example, using a punched sheet or plate, an expanded mesh, or woven wire. The anode should be sufficiently porous to permit anolyte and chlorine to pass therethrough. Suitable metals are well known to include tantalum, tungsten, columbium, zirconium, molybdenum, and preferably, titanium and alloys containing major amounts of these metals, coated with an activating substance, for example, an oxide of a platinum group metals, such as ruthenium, iridium, rhodium, platinum, palladium, either alone or in combination with an oxide of a film-forming metal. Other suitable activating oxides include cobalt oxide.

The electrolytic cell of the present invention, when stacked adjacent to other such cells, may have the anode 36 and the cathode 38 spaced apart by an ion exchange membrane 44 which is in contact with the anode 36. If desired, however, although not preferred, the membrane 44 could be in contact with the cathode 38 or be suspended between the two electrodes. It is important, that the ion exchange membrane 44 separate the anode compartment 32 from the cathode compartment The solid polymer electrolyte cathode 38 is electrically contacted with the catholyte cover 22 through a heavy current collector 48, a mattress 42, and a light current collector 46.

The heavy current collector 48 is preferably attached to the catholyte cover 22 by welding, although it can be merely pressed against the catholyte cover 22, bolted to it, or attached in some other way.

Suitable materials for use as the heavy current collector 48 may include iron, nickel, lead, molybdenum, cobalt, and alloys including major amounts of these metals. The heavy current collector should be sufficiently porous to permit catholyte and hydrogen to pass therethrough. The heavy current collector can be made permeable by several means including, for example, using a punched sheet or plate, an expanded mesh, or woven wire. The thickness of the material should be such that it provides adequate support of a mattress 42 and a light current collector 46. Current collectors, are illustrated in, for example, U.S. Pat. No. 4,444,641. That patent is hereby incorporated by reference for the purposes of its teaching about current collectors.

The mattress 42 may be constructed of metals which include iron, nickel, molybdenum, cobalt, and alloy including major amounts of these metals. Actual selection may depend upon the concentration of the alkali metal hydroxide in the aqueous solution. The mattress may be made hydraulically permeable, for example, using a woven and/or non-woven wire construction which allows for compression of the material when "sandwiched" between heavy current collector 48 and light current collector 46. Various mattress suitable for use in the present invention have configurations which are illustrated in U.S. Pat. No. 4,340,452 and U.S. Pat. No. 4,444,632. These patents are incorporated by reference for the purposes of the resilient cell elements that they teach.

Of course, it is within the scope of this invention for the electrolysis cell formed between the two cell segments to be a multi-compartment electrolysis cell using more than one solid polymer electrolyte membrane, e.g., a three-compartment cell with one membrane and one solid polymer electrolyte membrane spaced from one another so as to form a compartment between them as well as the compartment formed on the opposite side of each between the separator and its respective adjacent filter press cell unit.

To minimize leakage of electrolyte from the cell after assembling a number of the structural frames 10 together, at least one gasket (not shown) is positioned between adjacent plastic frames. During assembly of the frames a compressive force is applied to the extremes of the frames to compress the gasket material so that it both seals the ion exchange membrane 44, positions the membrane, and minimizes leakage of electrolyte from within the final cell series to the exterior of the cells. Preferably, the membrane 44 is positioned to substantially entirely prevent leakage of electrolyte from within the final cell series to the exterior of the cells. Various gaskets materials can be used including, for example, fluorocarbon, chlorinated polyethylene rubber, and ethylene propylene diene terpolymer rubber. This invention also encompasses the use of gaskets on both sides of solid polymer electrolyte membrane 44.

Inlets and outlets are provided through the flanges 34 or 34*a* to provide pathways for the introduction of reactants into the cell and the removal of products from the cell. Such outlets may be positioned as desired and have the number and cross-sectional area as determined by the operating conditions of the cell. Such designs are well known in the art.

In operating the cell series as an electrolysis cell series for NaCl brine, certain operating conditions are preferred. In the anode compartment a pH of from about 0.5 to about 5.0 is desired to be maintained. The feed brine preferably contains only minor amounts of multivalent cations (less than about 80 parts per billion when expressed as calcium). More multivalent cation concentration is tolerated with the same beneficial results if the feed brine contains carbon dioxide in concentrations lower than about 70 ppm when the pH of the feed brine is lower than 3.5.

Operating temperatures can range from about 0° to about 110° C., but preferably from about 60° C. to about 80° C. Brine purified from multivalent cations by ion-exchange resins after conventional brine treatment has occurred is particularly useful in prolonging the life of the solid polymer electrolyte membrane. A low iron content in the feed brine is desired to prolong the life of the solid polymer electrolyte membrane. Preferably the pH of the brine feed is maintained at a pH below 4.0 by the addition of hydrochloric acid.

Preferably the operating pressure is maintained at less than 7 atmospheres.

Usually the cell is operated at a current density of from about 1.0 to about 4.0 amperes per square inch, but in some cases operating above 4.0 amps/in.$^2$ is quite acceptable.

We claim:

1. A structural frame adapted for use in an electrolytic cell comprising:

an organic plastic member with a plurality of horizontally and vertically spaced-apart shoulders protruding outwardly from opposing generally coplanar first and second surfaces of said plastic member;

at least one electrically conductive insert extending from an exterior face of a shoulder on the first surface of the plastic member, through the plastic member, to an exterior face of a shoulder on the second surface of the plastic member, wherein each of said shoulders annularly encircle and support said insert;

an electrically conductive, substantially completely hydraulically impermeable second cover resistant to the corrosive effects of electrolyte matingly contacted with the second surface of said plastic member and adapted to minimize contact between the electrolyte and said plastic member within the cell;

an electrically conductive, substantially completely hydraulically impermeable first cover resistant to the corrosive effects of electrolyte matingly contacted with the first surface of said plastic member and adapted to minimize contact between the electrolyte and said plastic member within the cell;

a hydraulically permeable, electrically conductive, current collector adjacent to and contacting the first cover;

an ion exchange membrane adjacent to and contacting the current collector; and an electrically conductive, electrocatalytic material bonded to or embedded in the surface of the ion exchange membrane contacting the current collector.

2. The frame of claim 1 wherein the second cover is a metal selected from the group consisting of titanium, tantalum, zirconium, tungsten, and alloys thereof.

3. The frame of claim 1 wherein the first cover is a metal selected from the group consisting of iron, steel, stainless steel, nickel, lead, molybdenum, cobalt, and alloys thereof.

4. The frame of claim 1 wherein the insert is a metal selected from the group consisting of aluminum, copper, iron, steel, nickel, titanium, and alloys thereof.

5. The frame of claim: 1 wherein said second and first covers are attached directly to said insert.

6. The frame of claim 1 wherein the second cover is titanium, or an alloy thereof;

at least a portion of said inserts are composed of a ferrous-containing material; and said cover is attached, by welding, to at least a portion of said ferrous-containing inserts through an intermediate metal which is weldable compatible with said titanium cover and said ferrous-containing insert.

7. The frame of claim 1 wherein the plastic is selected from the group consisting of polyethylene, polyproplylene, polyvinylchloride, polystyrene, polysulfone, styrene acrylonitrile, chlorinate polvinylchloride, acrylonitrile, butadiene and styrene copolymers, epoxy, vinyl esters, polyesters, and fluoroplastics.

8. The frame of claim 1 wherein the plastic contains an additive selected from the group consisting of fiberglass, graphite fibers, talc, glass beads, asbestos, and pulverized mica.

9. The frame of claim 8 wherein the plastic contains from about 5 to about 75 weight percent of the additive.

10. The frame of claim 1 wherein the plastic contains an additive to reduce thermally induced expansion of said plastic member.

11. The frame of claim 1 wherein said plastic member has a peripheral flange extending outwardly from the second and the first surfaces of said plastic member.

12. The frame of claim 11 wherein the flange extends outwardly from the plastic member about the same distance as said insert.

13. An electrolytic cell comprising:

a plurality of the structural frames of claim 1 removably and sealably positioned in a generally coplanar relationship with each other and each of said plastic members being spaced apart by a second electrode on one side of each of said frames and a first electrode on an opposing side of each of said frames.

14. The cell of claim 13 wherein each of said second and first covers are welded to at least a portion of said inserts the second electrode and the first electrode are welded to the respective covers at locations adjacent to said inserts.

15. The cell of claim 14 wherein the plastic is selected from the group consisting of polyethylene, polypropylene, polyvinylchloride, chlorinated polyvinylchloride, acrylonitrile, polystyrene, polysulfone, styrene acrylonitrile, butadiene and styrene copolymers, epoxy, vinyl esters, polyesters, and fluoroplastics.

16. The cell of claim 14 wherein the plastic contains an additive selected from the group consisting of fiberglass, graphite fibers, carbon fibers, talc, glass beads, asbestos, and pulverized mica.

17. The cell of claim 16 wherein the plastic contains from about 5 to about 75 weight percent of the additive.

18. The cell of claim 16 wherein said plastic member has a peripheral flange extending outwardly from the second and the first surfaces of the plastic member.

19. The cell of claim 13 wherein the second cover is selected from the group of materials consisting of titanium, tantalum, zirconium, and tungsten.

20. The cell of claim 13 wherein the first cover is selected from the group of materials consisting of iron, steel, stainless steel, nickel, lead, molybdenum, cobalt, and alloys thereof.

21. The cell of claim 13 wherein the insert is selected from the group of materials consisting of aluminum, copper, iron, steel, nickel, titanium, and alloys thereof.

22. The cell of claim 13 wherein said second and first covers are welded directly to said insert.

23. The cell of claim 13 wherein the second cover is titanium or an alloy thereof, said insert is a ferrous-containing material and a vanadium disk is positioned between, and welded to, said second cover and said insert.

24. The cell of claim 13 wherein the plastic contains an additive to reduce thermally induced expansion of said plastic member.

25. The cell of claim 13 wherein said plastic member has a peripheral flange extending outwardly from the second and the first surfaces of said plastic member.

26. The cell of claim 25 wherein the flange extends outwardly from the plastic member about the same distance as said inserts.

27. A structural frame adapted for use in a chlor-alkali electrolytic cell for producing gaseous chlorine and an aqueous alkali metal hydroxide solution from an aqueous alkali metal chloride brine comprising:

a glass filled polypropylene member with a plurality of horizontally and vertically spaced-apart shoulders protruding outwardly from opposing generally coplanar second and first surfaces of said polypropylene member;

at least one electrically conductive steel insert extending through said polypropylene member such that said insert is generally annularly encircled by a shoulder on each opposing surfaces of said polypropylene member;

a substantially completely hydraulically impermeable titanium second cover matingly affixed to the second surface of said polypropylene member and adapted to minimize contact between the electrolyte and said polypropylene member within the cell; and a substantially completely hydraulically impermeable nickel first cover matingly affixed to the first surface of said polypropylene member and adapted to minimize contact between the electrolyte and said polypropylene within the cell.

* * * * *